US005668355A

United States Patent [19]

Jaminet et al.

[11] Patent Number: 5,668,355

[45] Date of Patent: Sep. 16, 1997

[54] ELEVATOR CAB DOOR DRIVE SYSTEM

[75] Inventors: Jerome F. Jaminet, South Windsor; Thomas M. Kowalczyk, Farmington; Edward E. Ahigian, West Hartford; Thomas M. McHugh, Farmington; Thomas He, Unionville; Richard E. Peruggi, Glastonbury; Richard E. Kulak, Bristol; David W. Barrett, East Hartland, all of Conn.

[73] Assignee: Otis Elevator Company, Farmington, Conn.

[21] Appl. No.: 224,441

[22] Filed: Apr. 7, 1994

[51] Int. Cl.[6] ..... B66B 13/14

[52] U.S. Cl. ..... 187/316; 187/315; 310/13; 49/118

[58] Field of Search ..... 187/316, 315; 49/121, 118, 117; 310/12, 13

[56] References Cited

U.S. PATENT DOCUMENTS

| | | | |
|---|---|---|---|
| 1,881,016 | 10/1932 | Rose . | |
| 4,188,552 | 2/1980 | Brimer | 310/13 |
| 4,450,493 | 5/1984 | Watrous | 360/106 |
| 4,503,637 | 3/1985 | Parente | 49/141 |
| 4,876,765 | 10/1989 | Karita | 16/102 |
| 5,172,518 | 12/1992 | Yoshino | 49/360 |
| 5,271,181 | 12/1993 | Pietro | 49/118 |
| 5,373,120 | 12/1994 | Barrett et al. | 187/316 |

FOREIGN PATENT DOCUMENTS

| | | |
|---|---|---|
| 3293282 | 4/1992 | Japan . |

*Primary Examiner*—Robert Nappi

[57] ABSTRACT

The door or doors on an elevator cab are driven during their opening and closing cycles by a linear induction motor drive system. The primary of the linear motor is fixed to the cab assembly, and the secondary is mounted on the door hanger panel and moves with the door. In order for the secondary to maintain a proper spacing relative to the primary, a flexible connection is provided between the secondary and the remainder of the door. In this way, shifting of the door during its opening and closing movements will not cause misalignment of the secondary with respect to the primary.

3 Claims, 1 Drawing Sheet

ELEVATOR CAB DOOR DRIVE SYSTEM

TECHNICAL FIELD

This invention relates to an improved elevator door operating system which utilizes a linear induction motor to open and close the doors. The primary component of the linear motor is secured to the cab, and the secondary component is formed by an upper marginal portion of the door which is flexibly connected to the remainder of the door.

BACKGROUND ART

Elevator cab doors are typically mounted on a track via guide rollers, the track being secured to the cab. Door opening and closing motion of the door or doors is caused by an electric drive motor which is mounted on the cab. The drive motor is a reversible motor which drives one or two sets of articulated arms that are pivotally attached to the door or doors. These drives are relatively complex assemblages, and require a large number of components. These drives also create high levels of stress on the cab due to the long levers used to open and close the doors. The reaction forces created by flexing the levers tend to cause the drive motor to twist on the cab. This reactive twist occurs in both directions, and requires reinforced cab structure to stabilize the cab.

DISCLOSURE OF THE INVENTION

This invention is directed to a linear induction motor elevator cab door drive assembly which includes a primary winding component which is fixed to the cab (there being one primary component to each door panel in an opposite opening and closing door system). The secondary component of the linear motor is disposed on the upper marginal portion of the doors being driven by the respective primaries. The secondary component is attached to the remainder of the door panel by means of a flexible joint, preferably a piano-type hinge joint. The motor secondary component is disposed above the door hanger panels on which the door guide rollers are mounted. The hanger panel and the remainder of the door are rigidly connected to each other. The flexible connection between the secondary panel and the remainder of the door ensures that the proper positioning of the secondary relative to the primary will be maintained during opening and closing movement of the doors. Without the flexible connection between the secondary panel and the remainder of the door, forward and backward motion of the door which may be caused by deviations in the position of the roller guide track, or by deviation in the position of the door sill guide channel can disrupt the delicate primary/secondary positioning needed to ensure proper operation of the linear motor drive assembly.

It is therefore an object of this invention to provide an elevator cab door drive which employs a linear induction motor for supplying motive drive to the doors during the opening and closing motion on the elevator cab.

It is a further object of this invention to provide a door drive of the character described which significantly reduces door drive-induced cab stress so as to allow cab structures which do not need to be unduly reinforced.

It is another object of this invention to provide a door drive of the character described which ensures proper primary-secondary spacing during opening and closing of the door, irregardless of door oscillations which may occur as the doors move between their closed and open positions.

These and other objects and advantages of the invention will become more readily apparent from the following detailed description of a preferred embodiment of the invention when taken in conjunction with the accompanying drawings, in which:

BEST MODE FOR CARRYING OUT THE INVENTION

Figure 1:
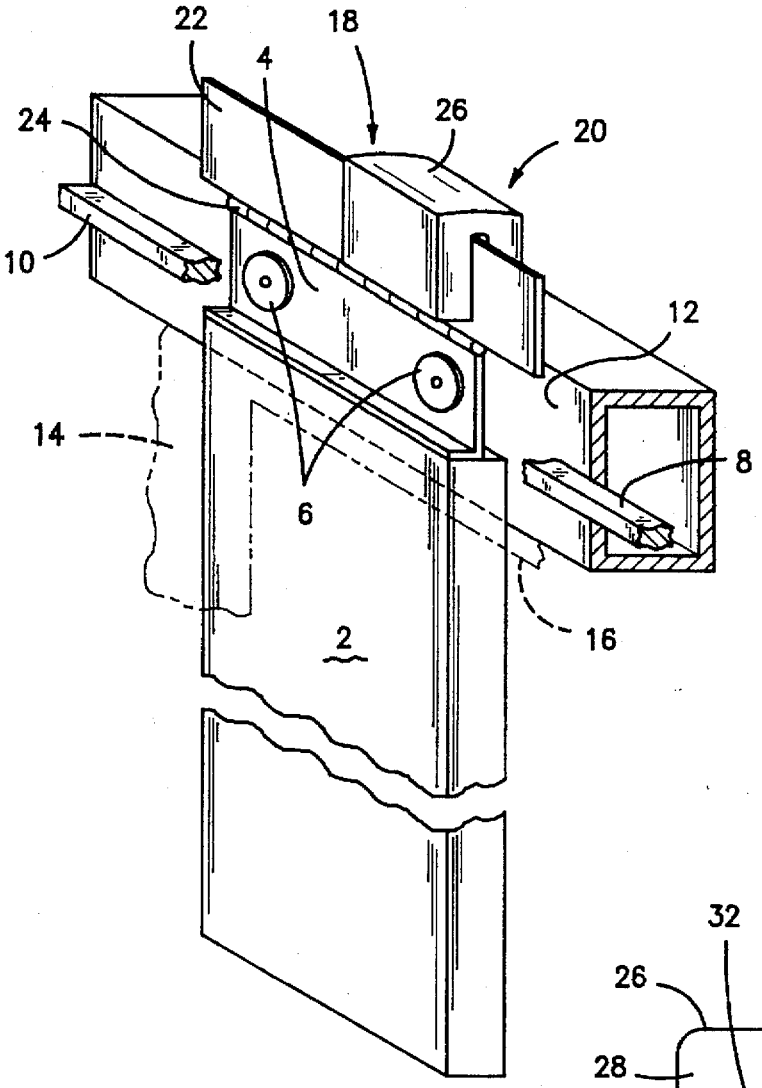
FIG. 1 is a fragmented perspective view of the door drive and door mounting system of this invention.

Referring now to the drawings, there is shown in FIG. 1 an embodiment of the linear motor door drive and door mounting system of this invention. The cab door 2 includes a hanger panel 4 on which the door guide rollers 6 are mounted. The rollers 6 move back and forth over the upper surface 8 of a guide track 10 which is secured to a header beam 12 which is mounted on the cab 14 above the cab entrance 16 (shown in phantom).

The linear motor door drive assembly is denoted generally by the numeral 18. The door drive assembly 18 includes a primary assembly denoted generally by the numeral 20 which is fixedly mounted on the cab header beam 12, and a movable secondary 22 which is a sheet of a conductive metal, preferably copper. The secondary 22 is flexibly connected to the door hanger panel 4 by means of a hinge mount 24. The hinge mount 24 is preferably a piano type hinge but may also be a continuous flexible plastic or metallic strip.

Figure 2:
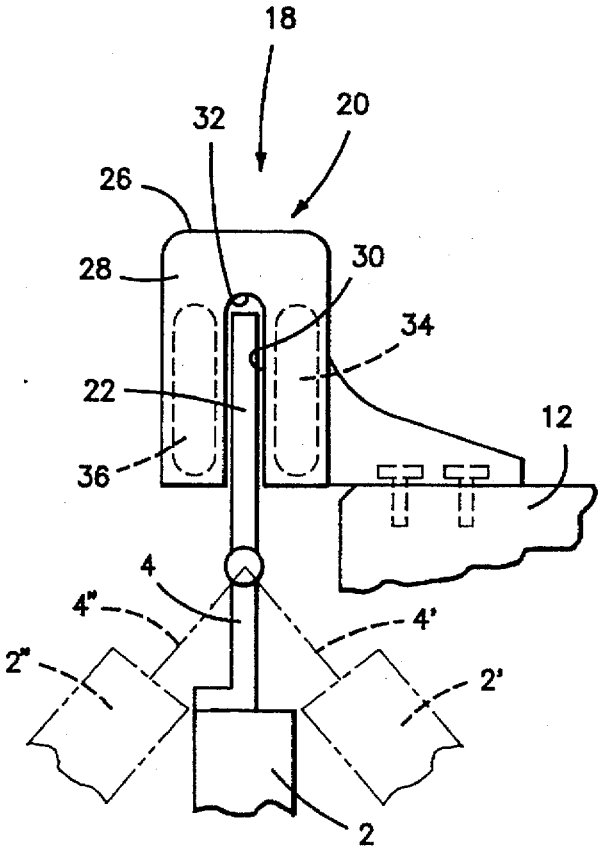
FIG. 2 is a fragmented end elevational view of the system which illustrates the flexibility of door movement.

As shown in FIG. 2, the primary assembly 20 includes a clamshell housing 26 which has opposed end walls 28 with openings 30 through which the secondary 22 passes. The openings 30 have arched upper surfaces 32 which aid in resisting the normal forces exerted on the housing 26 by the primary assembly 18. The primary assembly 18 includes a primary winding component 34 which is disposed inside of the housing 26, and a fixed magnetic backiron component 36 which completes the electromagnetic flux path through the copper secondary 22. The secondary 22 will be thrust in either direction (door-closing, or door-opening) depending on the direction of current flow through the primary assembly 18.

In the event that the path of the guide track 10 or the door sill guide (not shown) deviates from a straight opening/closing line, the door assembly, i.e., the hanger panel 4, and door 2 can pivot about the hinge 24 to the positions 2' 2" and 4', 4" (which are illustrated in exaggerated fashion in FIG. 2) without causing a significant deflection of the copper secondary panel 22 relative to the primary winding 34 and magnetic backiron 36.

The flexible connection between the door and the linear motor secondary allows the drive system to operate efficiently even when door guidance components are misaligned and deviate from a straight door opening and closing line of motion.

Since many changes and variations of the disclosed embodiment of the invention may be made without departing from the inventive concept, it is not intended to limit the invention otherwise than as required by the appended claims.

What is claimed is:

1. An elevator cab door drive system comprising:

a) a track fixed to the cab above a cab entrance opening, said track providing guidance for a cab door during its opening and closing movement cycles;

b) a linear induction motor primary assembly, said primary assembly including a primary winding component which is fixed to the cab above said track;

c) a hanger panel forming a fixed upper portion of the door;

d) door guide rollers rotatably mounted on said hanger panel, said guide rollers being disposed for rolling movement over an upper surface of said track during opening and closing movement of the door;

e) a linear induction motor secondary member mounted on said hanger panel, said secondary member passing through a flux field created by said primary assembly whereby a thrust force will be applied to said secondary member to drive said door through its opening and closing cycles; and f) a flexible joint connecting said door with said secondary member so as to prevent through plane deflections of said door from causing misalignment of said secondary member and said primary winding component, said flexible joint is formed by a hinge.

2. The cab door drive system of claim 1 wherein said hinge extends along the path of travel of the door.

3. The cab door drive system of claim 1 wherein said primary assembly further comprises a magnetic backiron component adjacent to said primary winding component, said secondary member passing between said winding component and said backiron component.

* * * * *